US008006476B2

(12) United States Patent
Hösel et al.

(10) Patent No.: US 8,006,476 B2
(45) Date of Patent: Aug. 30, 2011

(54) DEVICE ON A TEXTILE MACHINE, ESPECIALLY A SPINNING PREPARATION MACHINE, FOR COOLING HEAT-EMITTING ELECTRICAL COMPONENTS

(75) Inventors: Fritz Hösel, Mönchengladbach (DE); Dieter Wirtz, Erkelenz (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 728 days.

(21) Appl. No.: 12/073,644

(22) Filed: Mar. 7, 2008

(65) Prior Publication Data

US 2008/0236178 A1 Oct. 2, 2008

(30) Foreign Application Priority Data

Mar. 30, 2007 (DE) ..... 10 2007 015 826

(51) Int. Cl.
*D01H 11/00* (2006.01)

(52) U.S. Cl. ..... 57/308

(58) Field of Classification Search ..... 57/308; 19/66 R

See application file for complete search history.

(56) References Cited

U.S. PATENT DOCUMENTS

| | | | | | |
|---|---|---|---|---|---|
| 4,074,750 | A | * | 2/1978 | Beghin | 165/89 |
| 4,107,910 | A | * | 8/1978 | Furstenberg et al. | 57/308 |
| 4,443,689 | A | * | 4/1984 | Muller et al. | 219/469 |
| 4,951,455 | A | * | 8/1990 | Blosl | 57/308 |
| 4,976,098 | A | * | 12/1990 | Meyer et al. | 57/308 |
| 5,208,955 | A | * | 5/1993 | Schiel | 492/12 |
| 5,277,690 | A | * | 1/1994 | Schiel | 492/12 |
| 5,321,942 | A | * | 6/1994 | Hartness | 57/301 |
| 5,431,004 | A | * | 7/1995 | Menegatto | 57/308 |
| 5,507,618 | A | * | 4/1996 | Kubo et al. | 415/182.1 |
| 5,549,154 | A | * | 8/1996 | Niskanen et al. | 165/89 |
| 5,575,143 | A | * | 11/1996 | Gengler | 57/308 |
| 5,920,961 | A | * | 7/1999 | Hollingsworth | 19/100 |
| 2007/0006423 | A1 | * | 1/2007 | Pferdmenges et al. | 19/98 |

FOREIGN PATENT DOCUMENTS

| | | | |
|---|---|---|---|
| DE | 44 23 441 | A1 | 1/1995 |
| EP | 0 532 457 | A1 | 8/1992 |
| WO | WO-2006/048303 | A1 | 5/2006 |

OTHER PUBLICATIONS

UK Intellectual Property Office Search Report, dated Jun. 23, 2008, issued in connection with counterpart British Application No. GB0805496.7.

* cited by examiner

*Primary Examiner* — Shaun R Hurley
(74) *Attorney, Agent, or Firm* — Venable LLP; Robert Kinberg; Ryan M. Flandro

(57) ABSTRACT

In a device on a textile machine, for cooling heat-emitting electrical components, for example electrical switching devices and/or switch cabinets, the heat-emitting components are cooled by an air stream. In order to provide a device that ensures the necessary cooling in a structurally simple way and is economical and low-maintenance, at least one partial air stream of the supply air to the machine is guidable towards the heat-emitting components and the supply air is able to absorb heat from the components and subsequently flow via outlet through components of the textile machine.

19 Claims, 8 Drawing Sheets

I - I

I - I

DEVICE ON A TEXTILE MACHINE, ESPECIALLY A SPINNING PREPARATION MACHINE, FOR COOLING HEAT-EMITTING ELECTRICAL COMPONENTS

CROSS REFERENCE TO RELATED APPLICATION

The present application claims priority from German Patent Application No. 10 2007 015 826.4 dated Mar. 30, 2007, the entire disclosure of which is incorporated herein by reference.

BACKGROUND OF THE INVENTION

The invention relates to a device on a textile machine, especially a spinning preparation machine, for cooling heat-emitting electrical components, for example electrical switching devices and/or switch cabinets.

In the field of the textile industry, especially in the field of spinning room preparation, in modern machine designs the switch cabinets necessary for operating the machine are generally integrated directly into the machine or its frame. On the one hand, that has the advantage that the connections between sensors and actuators as well as the corresponding switching devices can be kept very short and simple. On the other hand, however, that practice has the result that often only very limited space is available and so the switching devices usually have to be very closely and tightly packed into the switch cabinets. As a result, generally a relatively large amount of heat is generated, which is often considerably increased by the unfavourable ambient temperatures in the spinning room preparation area. For dissipating the resulting lost heat it is often necessary to use fans or even cooling units. The latter are generally ruled out from the outset on account of the considerable costs associated with their installation. Accordingly, only suitable fans remain. Because the environment in which such machines are operated contains very large amounts of dust, it is essential to equip the machines with dust-protection mats which prevent the dust from penetrating into the switch cabinet. Unfortunately, such mats become clogged after a relatively short time so that the inflow or outflow of air is no longer sufficient. That means, in turn, that regular cleaning of the mats is essential to ensure sufficient ventilation. Experience shows, however, that it is precisely this kind of maintenance that is carried out only very rarely, if at all. The consequence is therefore frequent stoppages and machine downtimes caused by overheated switch cabinets or switching devices.

A known device on a spinning room machine (WO 2006/048303A) has electronic components, such as frequency converters and the like, that produce so much heat that they require cooling. They are therefore provided with cooling fins which project into the exhaust air stream with which fly, dust and other impurities are extracted. That exhaust air stream is freed of its impurities in a filter and in so doing increasingly clogging arises. That reduces the air stream's volume and accordingly its cooling action. In order nevertheless to prevent overheating of the electronic components, the latter are provided with temperature sensors which in the event of an excessively high increase in temperature send a signal to a control device indicating the necessity to clean the filter. Progressive alerts can be given, culminating in disconnection of the power supply of the electronic components or shutdown of the drive means. The cost of that device is high in terms of equipment. A particular problem is that it is necessary to clean the filters in order to avoid or eliminate excessive heating. Finally, the warning device itself requires monitoring and maintenance.

SUMMARY OF THE INVENTION

It is an aim of the invention to provide a device of the kind described at the beginning which avoids or mitigates the mentioned disadvantages and which, in particular, provides the necessary cooling in a structurally simple way and is also economical and low-maintenance.

The invention provides an apparatus on a textile machine for cooling heat-emitting electrical components, wherein at least a portion of the air of a supply of air to the textile machine is guidable towards the heat-emitting components and said at least a portion of supply air is able to absorb heat from the components and subsequently flow through components of the textile machine.

Because the supply air of the textile machine is used for absorbing and dissipating heat from the electrical components, the necessary cooling is ensured in a way that is especially simple from the structural standpoint. In particular, the device is economical and requires virtually no cleaning or maintenance. A particular advantage is that the indrawn air required for removing fly, dust and other impurities from the machines is guided past or through the switch cabinets in such a way that a cooling action is produced for the devices located in the switch cabinet. Further advantages of the invention are:

1. no additional energy whatsoever is required for cooling;
2. because the cooling faces or elements around which the air flows can be suitably generously dimensioned, there is virtually no risk of unacceptable collection of lint, dust or the like;
3. the productivity of the machine, in the event of such contamination, can in some cases be considerably increased.

Advantageously, the switch cabinet is entirely or partly of double-walled construction. The cooling air is drawn through the resulting intermediate space. Advantageously, at the places at which devices that particularly generate heat are located on the mounting plate, additional cooling bodies can be mounted in the base facing the mounting plate. Preferably, the mounting plate is sealed with respect to the switch cabinet so that a virtually air-tight cavity is formed between them. The air necessary for removing waste from the machine is drawn through that cavity and thus a corresponding cooling action is achieved. Advantageously, at the places at which devices that particularly generate heat are located on the mounting plate, additional cooling bodies are mounted on the rear side of the mounting plate. Advantageously, the entire mounting plate is equipped with additional cooling bodies on its rear side. Advantageously, all or parts of the rear side of the mounting plate is/are provided with air-guide plates or the like. As a result, selective and better distribution of the cooling air can be effected. Preferably, the ventilation, or circulation of cooling air, is reinforced or improved by additional fans. Advantageously, the use and the performance of the fans are effected in dependence upon temperatures measured in the switch cabinet, at the switching devices or at the cooling bodies. For that purpose, corresponding sensors are advantageously mounted at particularly temperature-critical locations. They are advantageously connected to the machine controller, which evaluates the information and controls or regulates the fans accordingly. Preferably, the air leaving the switch cabinet is guided directly and by way of pipelines, ducts, hoses or the like to the inlet points of the extraction hoods (waste-removal points).

Advantageously, the wall faces of the air duct are associated with the switching devices and/or switch cabinets. Advantageously, the supply air is able to flow through the interior of a switch cabinet. Advantageously, the supply air is able to flow along the outer walls of the switching devices and/or switch cabinet. Advantageously, the supply air is able to flow through the interior of a double-walled cabinet door. The supply air may be a suction air stream. The supply air may be a compressed air stream. Advantageously, the supply air is subsequently able to flow through the interior of a casing of the textile machine, for example a flat card, roller card or the like. Advantageously, the air dissipates convective heat. Additionally or alternatively, the air dissipates radiant heat. In certain embodiments, the air at least partly sweeps along the inner wall of the switch cabinet.

Advantageously, the supply air is pre-cooled. Advantageously, the supply air stream can be matched to changed operating conditions. Advantageously, the supply air necessary for removing waste from the textile machine, especially dust, short fibres and the like, is drawn over or through the switch cabinets in such a way that a cooling action is produced for the devices located in the switch cabinet. Advantageously, indrawn air is drawn over the base of the switch cabinet and the latter is joined to a mounting plate that is in heat-receiving communication with the electrical components, said joining being in such a manner that the cooling action is also transmitted to the mounting plate.

Advantageously, the air-intake points of the machine are connected by way of air devices, for example ducts, hoses or the like, to corresponding inlet points in the switch cabinet. Advantageously, the air-outlet points are connected to the waste-removal points, for example suction hood. Advantageously, the indrawn supply air is guided directly over the rear side of the mounting plate. Advantageously, on the rear side of the mounting plate, preferably at a place where corresponding generation of heat is effected on the front side, there are mounted additional cooling bodies, for example cooling fins or the like, around which the indrawn air flows.

In certain preferred embodiments, the indrawn supply air is guided selectively to heat-emitting locations by corresponding guide devices, while other locations are omitted. Advantageously, one or more additional ventilation devices, for example, fans, support the movement of air at certain locations, for example in the region of cooling bodies.

In certain preferred embodiments, locations in the switch cabinet, at the switching devices or at the cooling bodies are provided with temperature sensors which are preferably connected to the machine controller and supply the latter with information relating to the corresponding temperatures, with the result that the machine controller is able, on the basis of preset temperature profiles, to control or regulate one or more ventilator devices, for example, fans, so that a sufficient cooling action is produced. Advantageously, when certain preset temperatures are reached, a warning message is transmitted to the operating unit or by means of some other optical and/or acoustic messaging device. Preferably, when certain preset critical temperatures are reached, a message is transmitted to the operating unit or by means of some other optical and/or acoustic messaging device and the machine is shut down.

In one embodiment, the switch cabinet is entirely or partly of double-walled construction and cooling air is drawn or blown through the space between the two walls.

The present invention also provides an apparatus on a textile machine, especially a spinning preparation machine, for cooling heat-emitting electrical components, for example electrical switching devices and/or switch cabinets, in which an air stream of the textile machine is guided towards the heat-emitting components, with an air stream flowing through the textile machine and subsequently being discharged, wherein at least one partial air stream of the supply air to the textile machine is guidable towards the heat-emitting components and the supply air is able to absorb heat from the components and subsequently flow through components of the textile machine.

Additionally, the invention provides a method for cooling switching components in a textile machine, comprising drawing in an air stream from outside the machine, passing at least a part of the air stream around or in the vicinity of the switching components in heat exchange relationship therewith and subsequently passing the air stream through at least one component of the textile machine.

DETAILED DESCRIPTION

Figure 1:
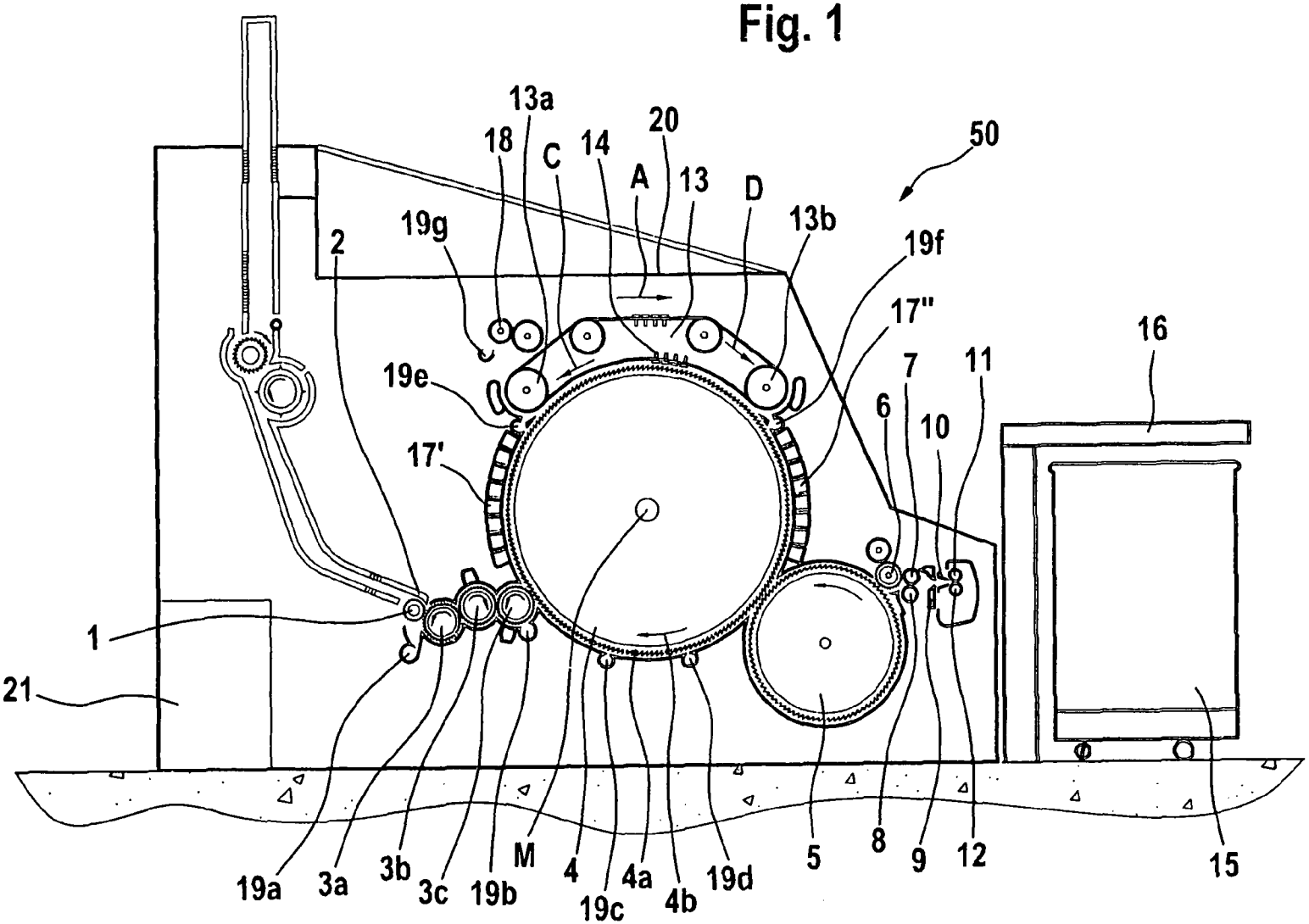
FIG. 1 is a diagrammatic side view of a flat card having an electrical switch cabinet and extraction points.
Figure 5A:
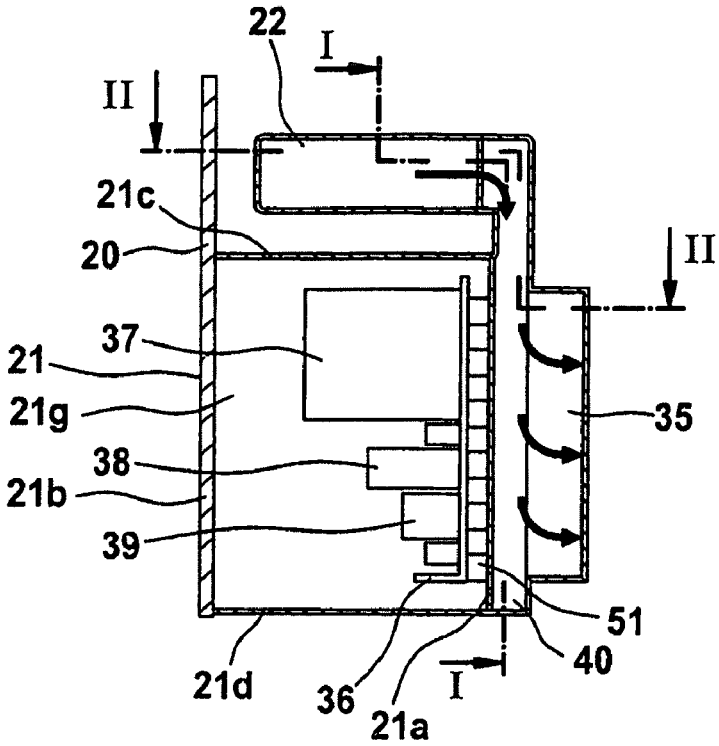
FIG. 5*a*, 5*b*, 5*c* show, in section, a side view (FIG. 5*a*), a plan view (FIG. 5*b*) and a front view (FIG. 5*c*) showing, in one embodiment, the way in which air is guided at and along the rear wall of a switch cabinet.

With reference to FIG. 1, a flat card 50, e.g. a TC 03 flat card, made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web guide element 9, web funnel 10, delivery rollers 11, 12, revolving card top 13 with card top guide rollers 13*a*, 13*b* and flats 14, can 15 and can coiler 16. The directions of rotation of the rollers are indicated by curved arrows. Reference letter M denotes the centre point (axis) of the cylinder 4 and A indicates the working direction. Reference numeral 4*a* indicates the clothing and reference numeral 4*b* indicates the direction of rotation of the high-speed cylinder 4. Reference letter C indicates the direction of rotation of the revolving card top 13 in the carding position and reference letter D indicates the return transport direction of the flats 14. In the pre-carding zone, between the licker-in 3*c* and the rear card top guide roller 13*a*, there is arranged a plurality of fixed carding elements 17' and in the post-carding zone, between the front card top guide roller 13*b* and the doffer 5, there is arranged a plurality of fixed carding elements 17". The returning flats are associated with a card top cleaning device having a rotating roller 18. Reference numerals 19*a* to 19*g* denote extraction hoods. The flat card is arranged in the interior of a housing 20 (casing). In the intake zone of the flat card there is arranged—integrated into the housing 20—an electrical switch cabinet 21 having electrical switching devices 37, 38, 39 (see FIG. 5*a*, 6*a* and 7*a*).

Figure 2:
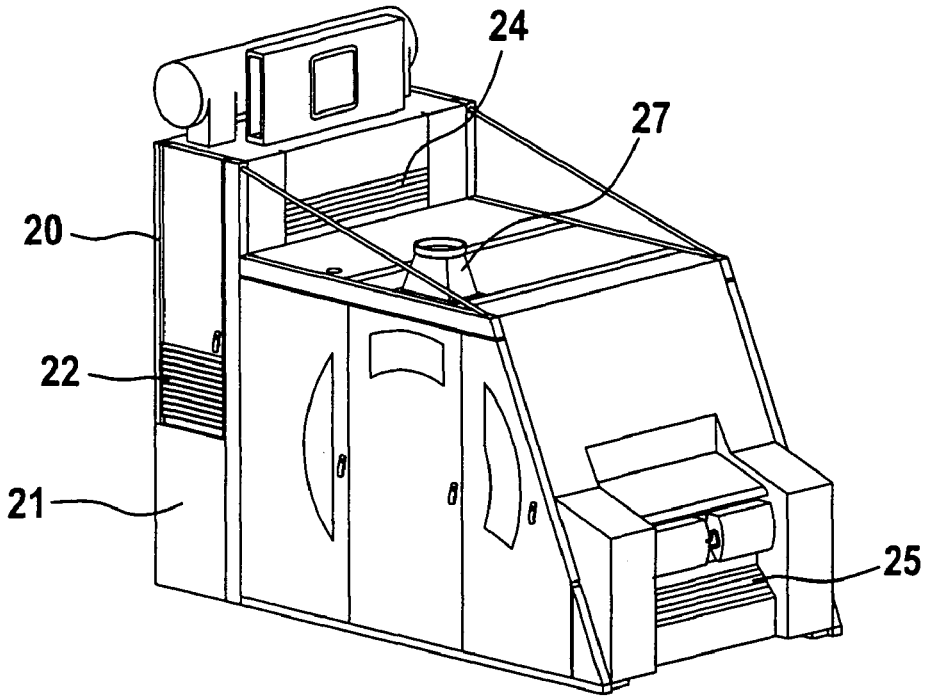
FIG. 2 is a perspective view of the casing (housing) of the flat card with air-intake points.
Figure 5B:
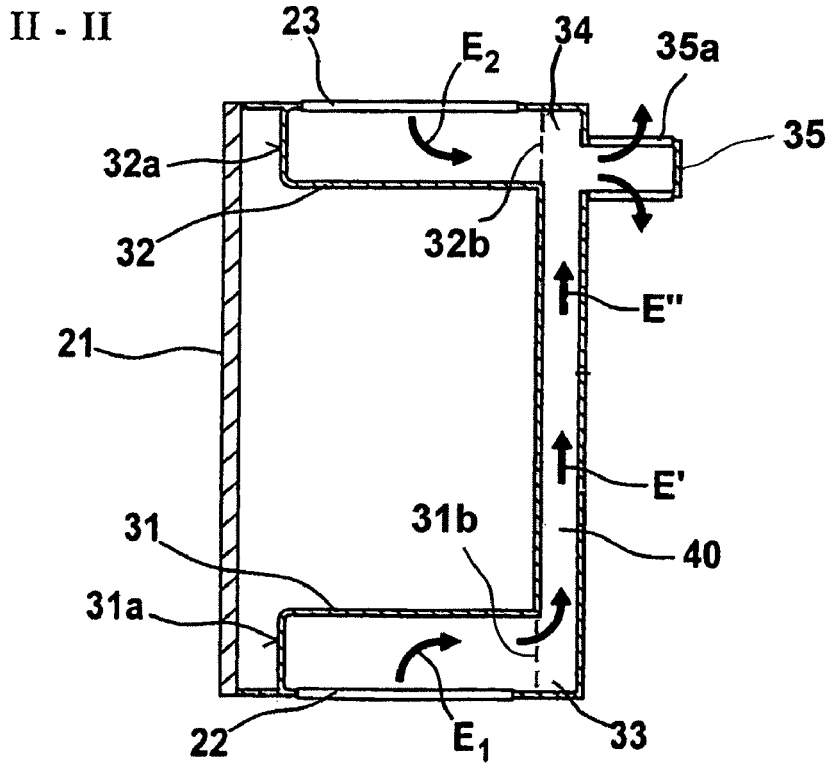
Figure 5C:
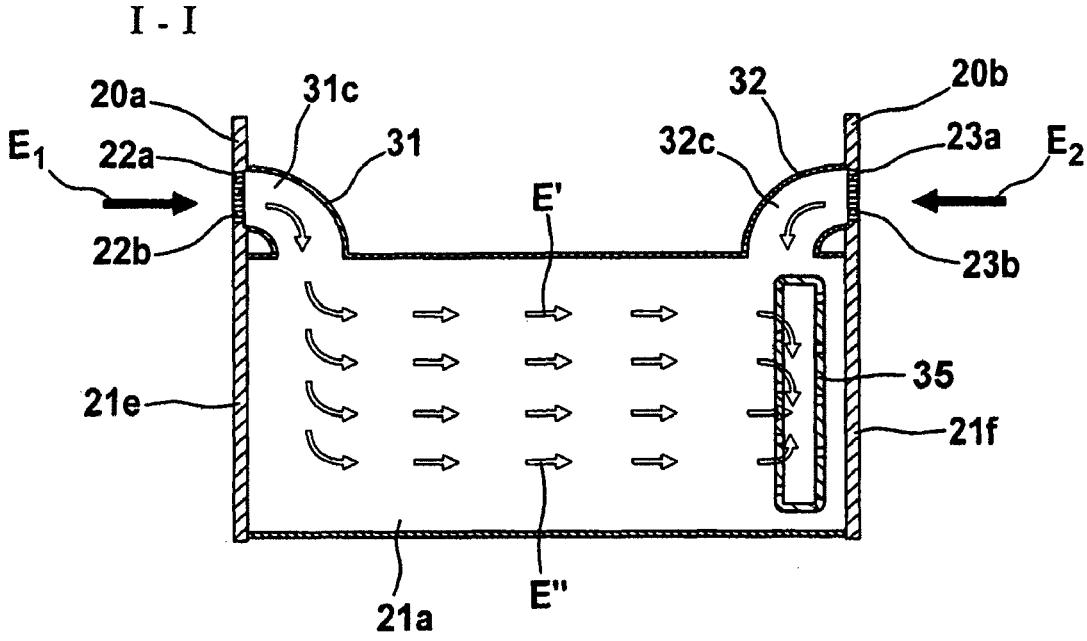
Figure 5D:
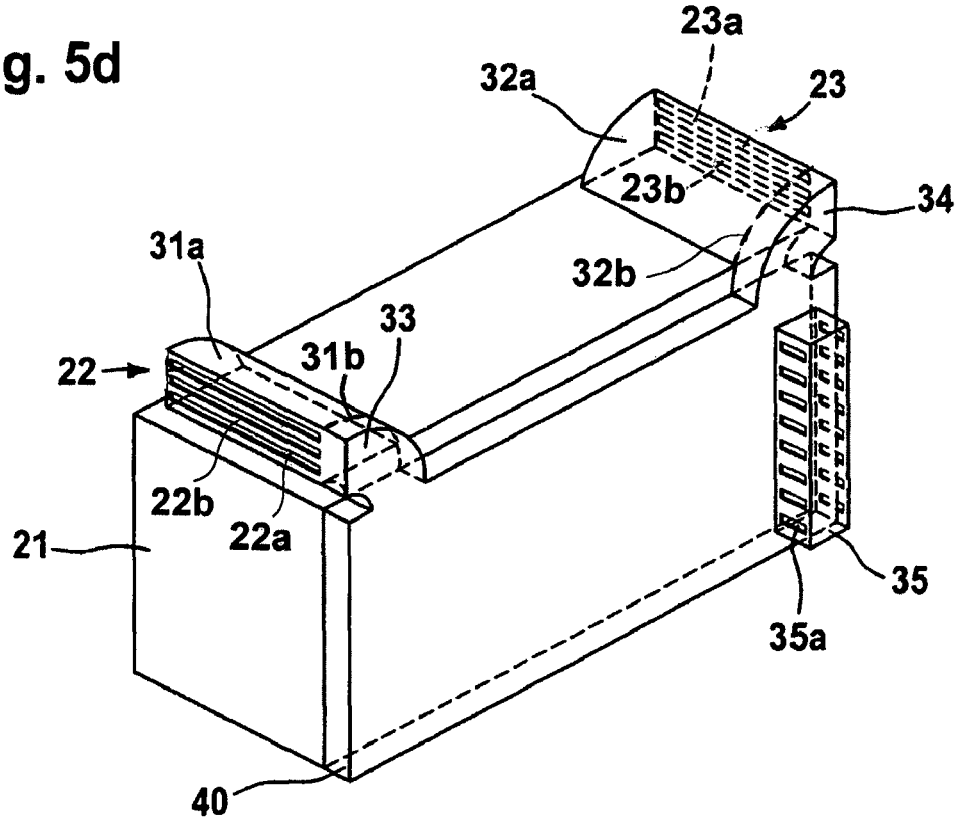
FIG. 5*d* is a perspective view of the embodiment according to FIG. 5*a* to 5*c;*

FIG. 2 shows one form of housing 20, suitable for housing a flat card according to an embodiment of the invention. The housing 20, which is made predominantly of sheet metal, is substantially closed on all sides. At five locations, air-inlet openings 22 to 26 (intake openings), of which air-inlet openings 22, 24 and 25 are shown, are located in wall faces of the housing 20. The air-inlet opening 23 is shown in FIGS. 5*b* and 6*b*. An air-inlet opening 26 (not shown) is located in the rear wall of the housing 20. All air-inlet openings, e.g., 22 to 26 have grille bars between which there are air-intake slots. For example, as shown in FIGS. 5*c* and 5*d*, air-inlet openings 22 and 23 include grille bars 22*b*, 23*b*, respectively, between which are air-intake slots 22*a*, 23*a*. Air from the atmosphere is drawn from the outside through the air-inlet openings 22 to 26 into the interior inside the housing 20. Reference numeral 27 denotes a central extraction duct which is connected to a suction source (not shown).

Figure 3:
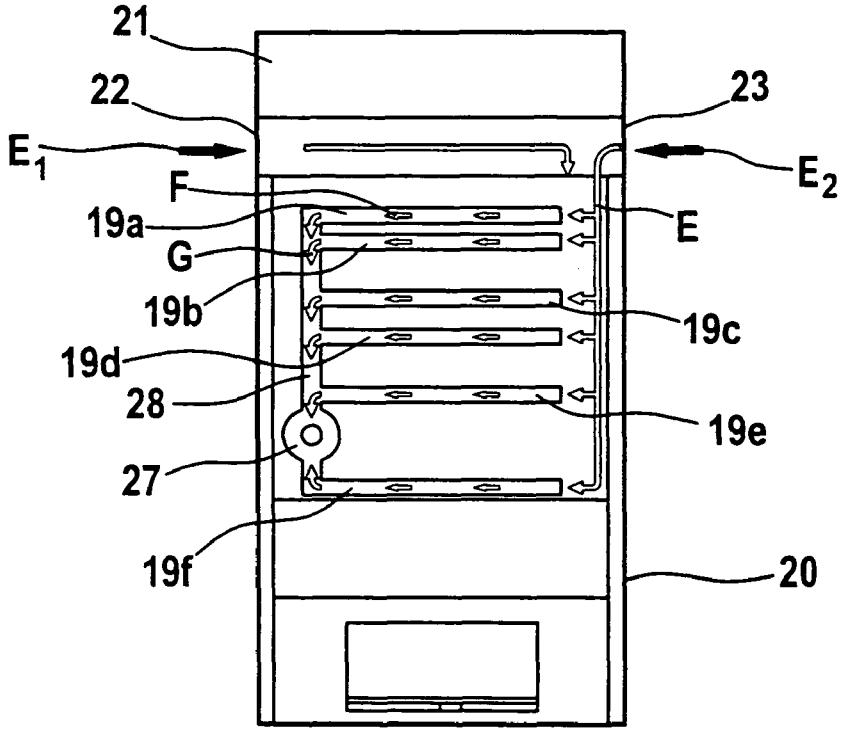
FIG. 3 is a diagrammatic plan view showing the way in which air is guided in a first apparatus according to the invention, with supplied and discharged air at the extraction points in the interior of the housing.

In the embodiment of FIG. 3, five extraction hoods 19*a* to 19*f* are present, one open end of each of which forms an air-inlet opening and the other end of each of which is connected to a common collecting line 28 which leads to the central extraction duct 27. The direction of the air streams is indicated by arrows E, F, G. The supply air streams $E_1$ and $E_2$ are drawn into the open air-inlet openings 22, 23, respectively, by suction, flow through the extraction hoods 19*a* to 19*f* as air streams F and are discharged from the outlet openings at the ends of the extraction hoods 19*a* to 19*f* and at the same time, as exhaust air streams G, by way of the collecting line 28 enter the extraction duct 27, from where they are extracted.

Figure 4:
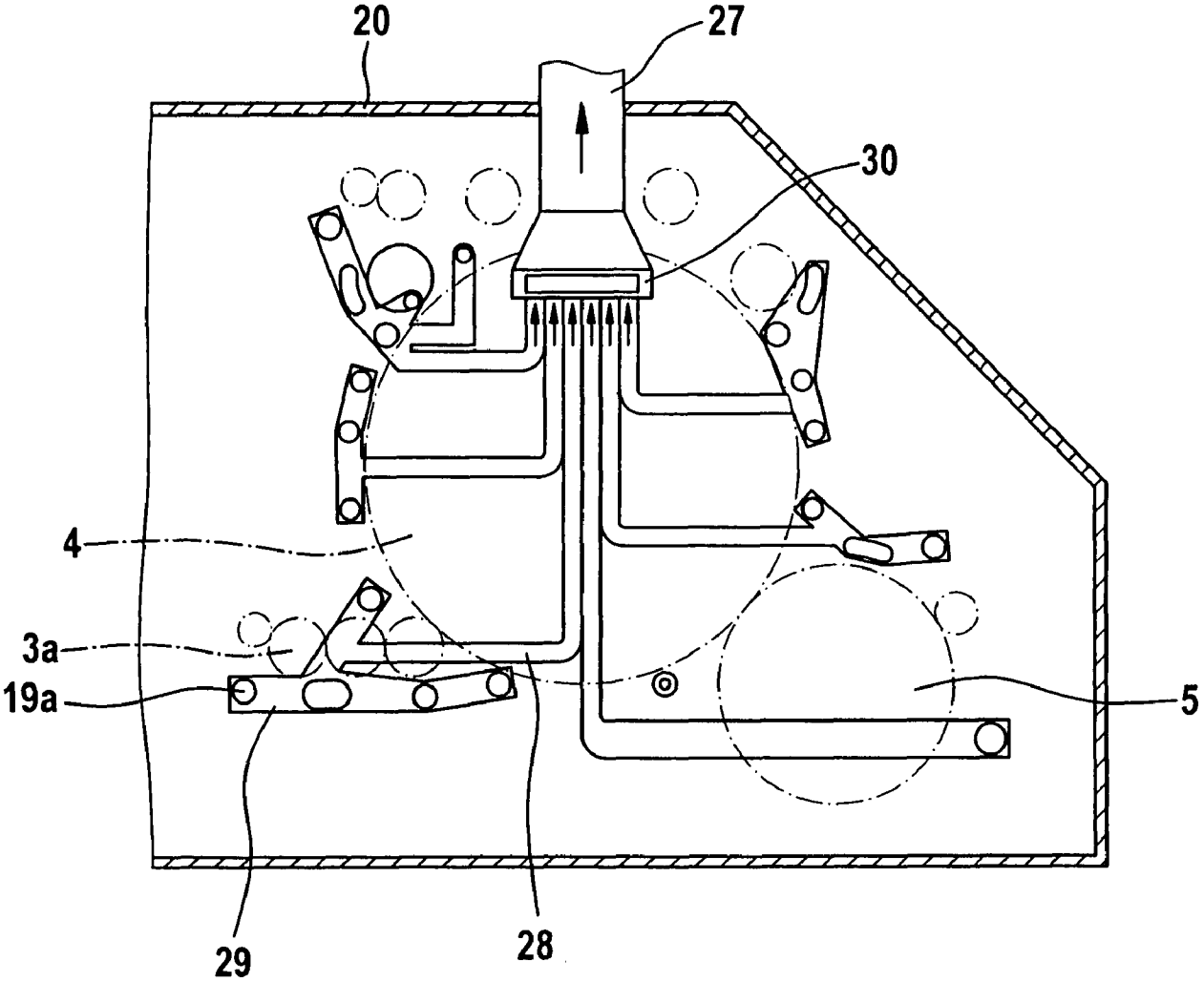
FIG. 4 is a diagrammatic side view of a flat card with a plurality of extraction points, a plurality of collecting lines and a central extraction duct.

Referring to FIG. 4, on a flat card, which may be the flat card 50 of FIG. 1, including, for example, housing 20, lickers-in 3*a*, high-speed cylinder 4, and doffer 5, there is a plurality of cleaning locations for dust, trash or the like, for example extraction hood 19*a*, which is acted upon by suction. A common extraction box (for example 29) is associated with several extraction points. The extraction boxes are each connected by way of an extraction line (for example 28) to the inlet of a collecting device 30. The outlet of the collecting device 30, for example a collecting box or the like, is connected to the central extraction duct 27, which is connected to a suction air source (not shown).

FIGS. 5*a* to 5*d* show diagrammatically the way in which air is guided at and along the rear wall 21*a* of an exemplary switch cabinet 21. The switch cabinet 21 is in the form of a sheet metal housing having a rear wall 21*a*, a front wall 21*b* (constructed as a door), a top wall 21*c*, a base wall 21*d* and two side walls 21*e* and 21*f*. In the interior 21*g* there is a mounting plate 36 for switching devices 37, 38, 39, which is attached to the inner side of the rear wall 21*a* by means of fastening elements 51. The door, which closes the front wall 21*b*, has a rubber seal all the way round, so that the interior 21*g* and thus the switching devices 37, 38, 39 are protected from dust. In the side walls 20*a* and 20*b* of the housing 20 there are air-inlet openings 22 and 23 which consist of horizontal parallel grille bars (elements) 22*b* and 23*b*, respectively, between which there are horizontal parallel air slots 22*a*, 23*a*, allowing the passage of air (see FIGS. 5*c*, 5*d*). The inner sides of the air-inlet openings 22 and 23 are connected to air hoods 31 and 32, respectively, which have approximately the shape of a quarter hollow cylinder in cross-section. In the case of air hoods 31, 32, one flat section face is associated with the air-inlet openings 22 and 23 and the other flat section face is associated with the top wall 21*c*. The ends 31*a*, 32*a* of the hoods 31, 32 associated with the top wall 21*c* are closed. The ends 31*b*, 32*b* opposite the ends 31*a*, 32*a* are open and allow the passage of air. The ends 31*b*, 32*b* are connected to bow-shaped, duct-like connection pieces 33, 34 which connect the interiors 31*c*, 32*c* (see FIG. 5*c*) of the air hoods 31, 32 to a duct space 40 associated with the rear wall 21*a*. In the region of the air hood 32, an outflow device 35 having air openings 35*a* is connected to the duct space 40.

In operation, the switching devices 37 to 39 give off a considerable amount of heat (the temperature in the interior 21*g* may be, for example, 60.degree. C.) which is partially delivered to the rear wall 21*a*. Supply air streams $E_1$ and $E_2$ from the spinning room (atmosphere) enter through the air slots 22*a* and 23*a* of the air-inlet openings 22 and 23, respectively, pass through the interiors 31*c* and 32*c* of the air hoods 31 and 32, respectively, and by way of the connection pieces 33 and 34 into the duct space 40. The air streams E', E" of the supply air stream $E_1$ (partial air stream) flow along the hot rear wall 21*a* (see FIG. 5*c*) and in so doing absorb heat. The cool supply air stream $E_1$ is accordingly used for cooling the rear wall 21*a* and thus the switching devices 37 to 39. The air streams E', E" so heated then flow through the air openings 35*a* of the outflow device 35 into the interior of the housing 20 of the machine 50, where it is drawn in by the extraction hoods (for example 19*a*). The supply air stream $E_2$ flows over a short distance, without absorbing heat, through the outflow device 35 into the interior of the housing 20.

Figure 6A:
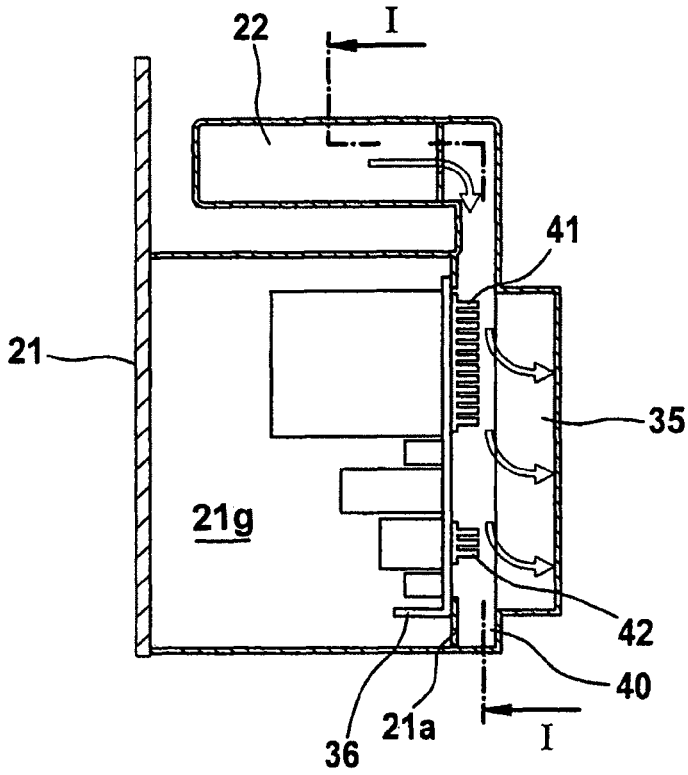
FIG. 6*a*, 6*b* show, in section, a side view (FIG. 6*a*) and a front view (FIG. 6*b*) of a further embodiment showing the way in which air is guided at and along cooling bodies.
Figure 6B:
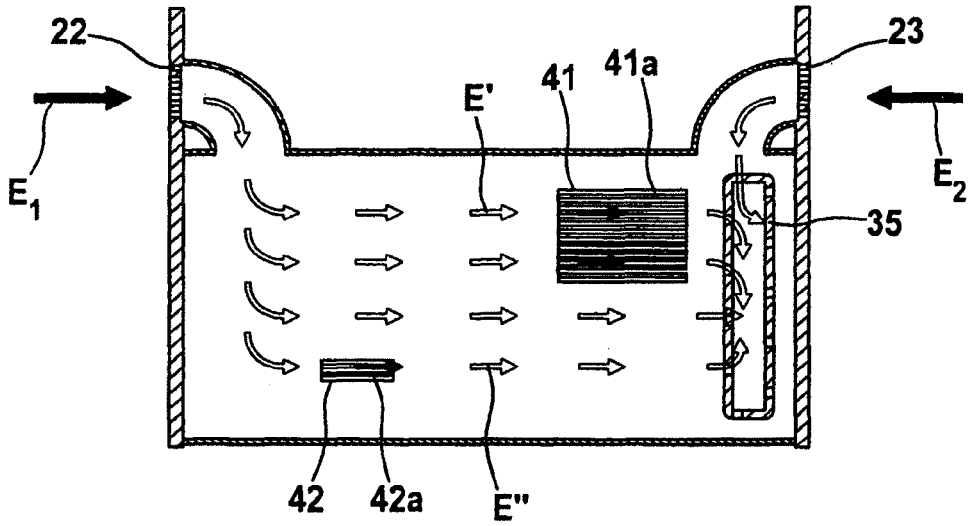

In the embodiment of FIG. 6*a*, the rear wall 21*a* has an opening which is closed by the mounting plate 36. Accordingly, the interior 21*g* is safeguarded against ingress of dust from the outside. On the outside of the mounting plate 36 there are mounted cooling bodies 41 and 42 having cooling fins 41*a* and 42*a*, respectively. The cooling fins 41*a*, 42*a* are arranged horizontally in the direction of flow of the supply air streams E', E" which flow between the cooling fins 41, 42*a* and in so doing absorb heat (see FIG. 6*b*).

Figure 7A:
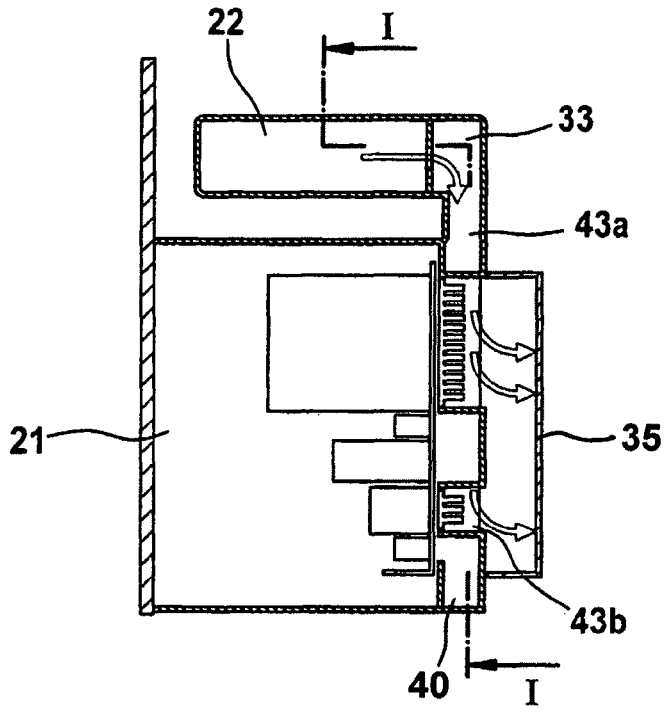
FIG. 7*a*, 7*b* are, in section, a side view (FIG. 7*a*) and a front view (FIG. 7*b*) of another embodiment showing the way in which air is guided analogously with FIG. 6*a*, 6*b*, wherein air-guide devices are present.
Figure 7B:
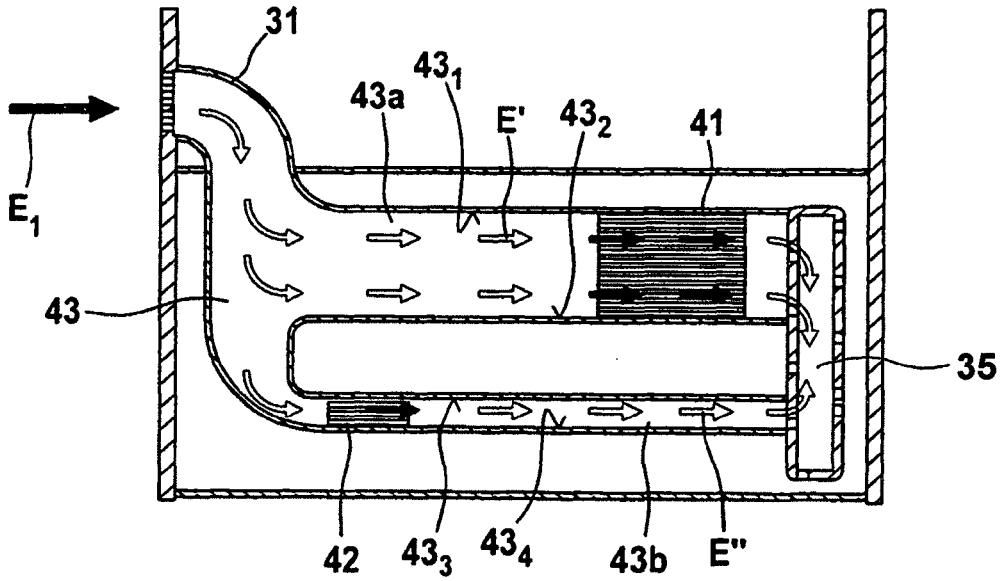

In the embodiment of FIG. 7*a*, 7*b*, the connection piece 33 is connected to an air-guide duct 43 which is divided into two sub-channels 43*a*, 43*b*, each of which has wall-shaped guide faces $\mathbf{43}_1$, $\mathbf{43}_2$ and $\mathbf{43}_3$, $\mathbf{43}_4$, respectively. The sub-channels 43*a*, 43*b* are located inside the duct space 40 which forms the lateral wall faces of the sub-channels 43*a*, 43*b*. In the interior of the sub-channels 43*a* and 34*b* there are located cooling bodies 41 and 42, respectively, through which the partial air streams E', E" flow. The sub-channels 43*a*, 43*b* open into the outflow element 35.

Figure 8:
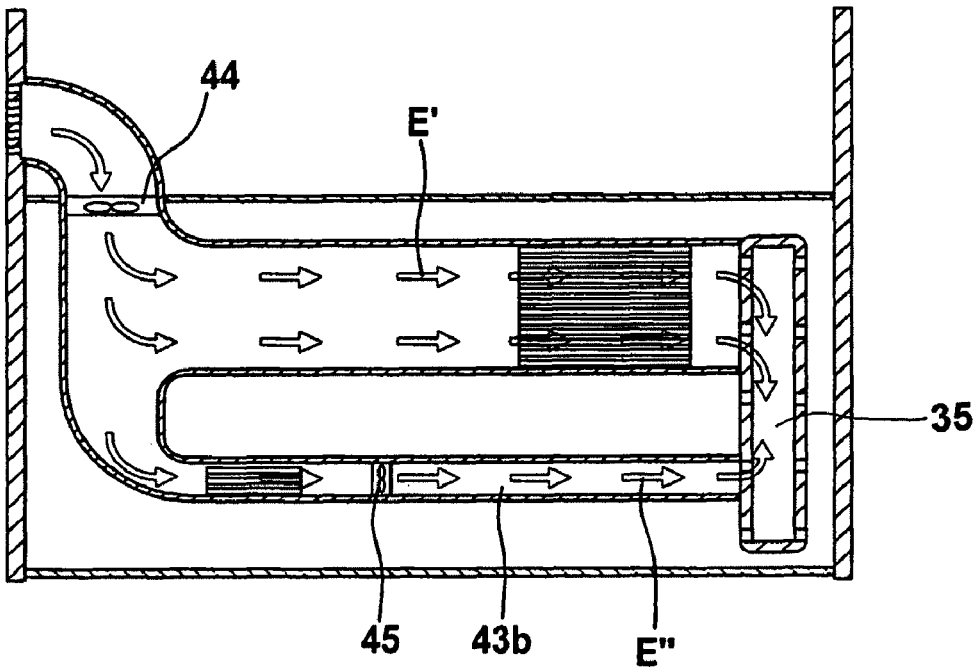
FIG. 8 is a front view of an embodiment similar to that of FIG. 7*b*, wherein fans are present.

In the embodiment of FIG. 8, the arrangement is similar to that of FIGS. 7*a* and 7*b*, but at the inlet of the air guide duct 43 and inside the sub-channel 43*b*, fans 44 and 45, supporting the air streams E', E", are additionally present.

Figure 9:
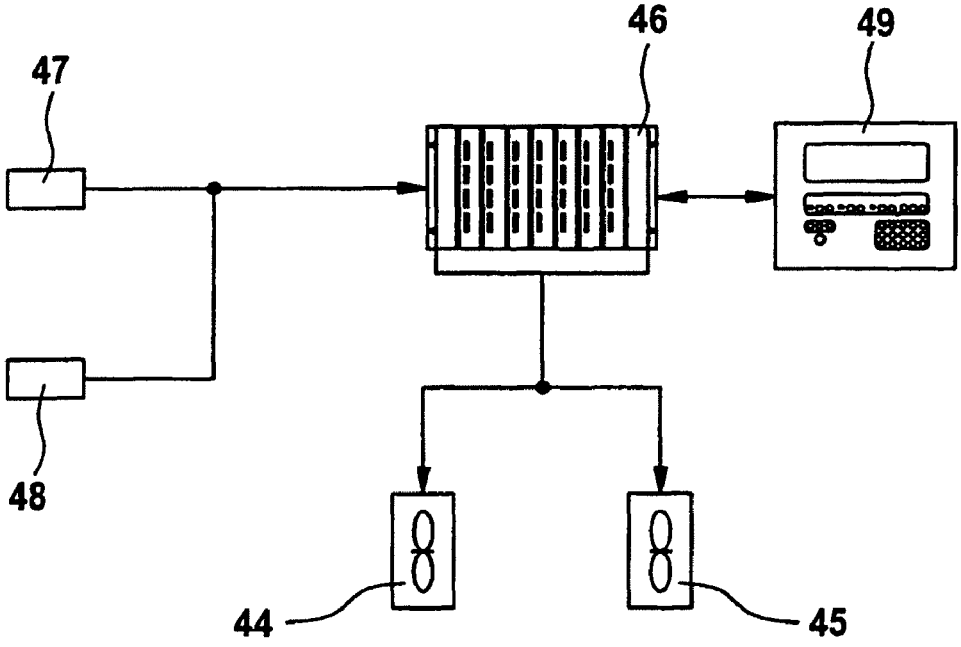
FIG. 9 shows diagrammatically a block circuit diagram of a control and regulation device for an apparatus of the invention, to which the fans, temperature sensors and an operating and display unit are connected.

With reference to FIG. 9, an electrical control and regulation device 46, for example a machine controller TMS 2, made by Trützschler GmbH & Co. KG is provided, to which the temperature sensors 47 and 48, the fans 44, 45 and an operating and display element 49 are connected. In that way, control or regulation of the additional fans 44, 45 is carried out in dependence upon the temperature measurement effected by the temperature sensors 47, 48. The temperature sensors may be provided at suitable locations in, or in the vicinity of, a switch cabinet. The control system of FIG. 9 is suitable for controlling a cooling system according to the invention and, with suitable adaptation where appropriate, may be used for controlling the cooling arrangements described with reference to any of FIG. 1 to 4, 5*a* to 5*d*, 6*a* to 6*b*, 7*a* and 7*b*, 8 or 9. It will be appreciated that other control arrangements are also possible.

Although the foregoing invention has been described in detail by way of illustration and example for purposes of understanding, it will be obvious that changes and modifications may be practised within the scope of the appended claims.

What is claimed is:

1. An apparatus on a textile machine for cooling heat-emitting electrical components, comprising:

a housing including an electrical switch cabinet, wherein the heat-emitting electrical components are mounted in an interior of the cabinet; and an air-inlet opening configured to pass supply air from outside into the cabinet, wherein at least a portion of the supply air absorbs heat from the heat-emitting electrical components, wherein the heated air subsequently flows from the cabinet interior into an interior of the housing and through spinning preparation components to remove waste from the textile machine.

2. The apparatus according to claim 1, wherein the supply air flows through an air duct in the cabinet, and wherein at least one wall face of the air duct is associated with the heat-emitting electrical components.

3. The apparatus according to claim 1, wherein the switch cabinet is entirely or partly of double-walled construction and the cooling supply air is drawn or blown through a space between the two walls.

4. The apparatus according to claim 1, wherein the supply air is drawn past a mounting plate for cooling the mounting plate, wherein the electrical components are mounted on the mounting plate, and further comprising a cooling body provided on a rear side of the mounting plate around which the air flows.

5. The apparatus according to claim 4, wherein the cooling body is provided at a location where heat is generated on a front side of the mounting plate.

6. The apparatus according to claim 1, wherein the supply air is a suction air stream.

7. The apparatus according to claim 1, wherein the supply air is a compressed air stream.

8. The apparatus according to claim 1, wherein the air dissipates convective heat.

9. The apparatus according to claim 1, wherein the air dissipates radiant heat.

10. The apparatus according to claim 1, wherein the supply air is pre-cooled.

11. The apparatus according to claim 1, wherein the supply air is adjustable to match changed operating conditions.

12. The apparatus according to claim 1, further comprising an outflow device configured to pass the heated air from the cabinet interior into an interior of the housing and connected to a waste-removal extraction hood.

13. The apparatus according to claim 1, further comprising an air guide duct including subchannels configured to selectively guide the supply air to heat-emitting locations.

14. The apparatus according to claim 1, further comprising fans configured to support the movement of air at one or more locations.

15. The apparatus according to claim 1, further comprising temperature sensors connected to a machine controller and configured to supply the controller with information relating to corresponding temperatures, whereby the machine controller is configured, on the basis of preset temperature profiles, to control or regulate the supply air to produce a sufficient cooling action.

16. The apparatus according to claim 15, wherein said control or regulation includes utilizing one or more fans.

17. The apparatus according to claim 15, wherein, when certain preset temperatures are reached, the controller generates a warning message.

18. The apparatus according to claim 17, wherein, when a warning message is generated, the controller is configured to shut down the machine.

19. The apparatus according to claim 1, further comprising a central extraction duct through which the air is discharged after flowing through the spinning preparation components of the textile machine.

* * * * *